US008365686B2

(12) United States Patent
Matsuoka et al.

(10) Patent No.: US 8,365,686 B2
(45) Date of Patent: Feb. 5, 2013

(54) MALFUNCTION DETECTION DEVICE FOR HOT WATER SUPPLIER

(75) Inventors: Shigehiko Matsuoka, Kusatsu (JP); Kouji Chida, Kusatsu (JP); Katsuya Kuwaki, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 1118 days.

(21) Appl. No.: 12/297,810

(22) PCT Filed: Apr. 17, 2007

(86) PCT No.: PCT/JP2007/058336

§ 371 (c)(1),
(2), (4) Date: Oct. 20, 2008

(87) PCT Pub. No.: WO2007/123117

PCT Pub. Date: Nov. 1, 2007

(65) Prior Publication Data

US 2009/0084329 A1 Apr. 2, 2009

(30) Foreign Application Priority Data

Apr. 19, 2006 (JP) ..... 2006-115125

(51) Int. Cl.
*F22B 37/42* (2006.01)
*F24D 11/02* (2006.01)

(52) U.S. Cl. ..... 122/14.1; 122/504; 122/504.2; 237/2 B

(58) Field of Classification Search ..... 122/14.1, 122/20 R, 504, 504.2; 237/2 B
See application file for complete search history.

(56) References Cited

U.S. PATENT DOCUMENTS

| | | | | |
|---|---|---|---|---|
| 3,730,265 | A * | 5/1973 | Lawrence | 165/134.1 |
| 4,943,003 | A * | 7/1990 | Shimizu et al. | 237/2 B |
| 5,279,319 | A * | 1/1994 | Fidelman | 137/14 |
| 5,465,588 | A * | 11/1995 | McCahill et al. | 62/127 |
| 6,129,284 | A * | 10/2000 | Adams et al. | 236/21 R |
| 6,212,894 | B1 * | 4/2001 | Brown et al. | 62/180 |
| 6,728,600 | B1 * | 4/2004 | Contaldo et al. | 700/274 |
| 7,024,877 | B2 * | 4/2006 | Yap | 62/238.6 |
| 7,726,263 | B2 * | 6/2010 | Ben-Ishai | 122/20 R |
| 7,735,458 | B2 * | 6/2010 | Stapensea | 122/20 R |
| 7,823,799 | B2 * | 11/2010 | Sakai et al. | 237/19 |
| 2002/0125242 | A1 | 9/2002 | Nomura et al. | |
| 2009/0056649 | A1 * | 3/2009 | MacKenzie | 122/504 |

FOREIGN PATENT DOCUMENTS

| | | | |
|---|---|---|---|
| CN | 1512666 | A | 7/2004 |
| JP | 11-108417 | A | 4/1999 |
| JP | 2000-39144 | A | 2/2000 |
| JP | 2002-168524 | A | 6/2002 |
| JP | 2003-222406 | A | 8/2003 |
| JP | 2003-254607 | A | 9/2003 |
| JP | 2004-190926 | A | 7/2004 |
| JP | 2005-114332 | A | 4/2005 |
| JP | 2005-283024 | A | 10/2005 |

* cited by examiner

*Primary Examiner* — Gregory A Wilson
(74) *Attorney, Agent, or Firm* — Global IP Counselors

(57) ABSTRACT

A malfunction detection device for a hot water supplier has a tank temperature detection thermistor for detecting a hot water temperature of a hot water storage tank and is configured such that when the detected hot water temperature of the hot water storage tank is a reference temperature or higher, a relay provided at a tank printed circuit board stops power supply from a tank unit to a heat pump unit. A heat pump shutdown command is a standby power saving command for saving a standby power of the heat pump unit.

11 Claims, 3 Drawing Sheets

MALFUNCTION DETECTION DEVICE FOR HOT WATER SUPPLIER

CROSS-REFERENCE TO RELATED APPLICATIONS

This U.S. National stage application claims priority under 35 U.S.C. §119(a) to Japanese Patent Application No. 2006-115125, filed in Japan on Apr. 19, 2006, the entire contents of which are hereby incorporated herein by reference.

BACKGROUND OF THE INVENTION

1. Field of the Invention

The present invention relates to a malfunction detection device for a hot water supplier (i.e. a water heater).

2. Background Art

A conventional heat pump hot water supplier has, as shown in FIG. 3, a heat pump unit 1 and a tank unit 2 storing hot water heated by the heat pump 1. The tank unit 2 includes, as shown in FIG. 1 showing an embodiment of the present invention, a hot water storage tank 3, a circulation path 12 connected with the hot water storage tank 3, and a heat exchanger path 14 interposed in the circulation path 12, and is capable of heating the heat exchanger path 14 by a heat pump heating source, boiling tepid, or low temperature water which has flowed out from the hot water storage tank 3 to the circulation path 12, and returning the boiled water to the hot water storage tank 3. Hot water stored in the hot water storage tank 3 is supplied to a bath and other places which are not shown in the figure.

The hot water storage tank 3 is provided with a feed water port 5 on its bottom wall, and with a hot water outlet 6 on its top wall. Tap water is supplied into the hot water storage tank 3 through the feed water port 5 and high temperature hot water is discharged from the hot water outlet 6. Furthermore, the hot water storage tank 3 is provided with a water intake 10 in an open condition on its bottom wall, and with a hot water inlet 11 in an open condition on the upper part of its side wall (peripheral wall). The water intake 10 and the hot water inlet 11 are connected by the circulation path 12. Provided in the circulation path 12 are a water circulating pump 13 and the heat exchanger path 14. A feed water flow path 8 is connected with the feed water port 5.

By the way, the hot water storage tank 3 is provided with four residual hot water quantity detectors 18*a*, 18*b*, 18*c*, and 11*d* vertically arranged in a predetermined pitch, and with a temperature detector 19*a* constituting a feed water temperature detecting section 19. Each of the residual hot water quantity detectors 18*a*, 18*b*, 18*c*, and 18*d* and the temperature detector 19*a* is constituted by, for example, a thermistor. Furthermore, the circulation path 12 is provided with an incoming water thermistor 20*a*, which serves as an incoming water temperature detecting section 20, upstream of the heat exchanger path 14, and with a discharged hot water thermistor 21*a*, which serves as a discharged hot water temperature detecting section 21, downstream of the heat exchanger path 14.

The circulation path 12 includes incoming water piping 15 and discharged hot water piping 16. The incoming water piping 15 consists of first piping 15*a* on the hot water storage tank 3 side in which the pump 13 is interposed, second piping 15*b* on the heat source side in which the incoming water thermistor 20*a* is interposed, and connecting piping 15*c* coupling (connecting) the first piping 15*a* and the second piping 15*b*. The discharged hot water piping 16 consists of first piping 16*a* on the hot water storage tank 3 side, second piping 16*b* on the heat source side in which the discharged hot water thermistor 21*a* is interposed, and connecting piping 16*c* coupling (connecting) the first piping 16*a* and the second piping 16*b* Connection of the connecting piping 15*c* and 16*c* is established at a site as described later.

The heat pump unit (heating source) 1 includes a refrigerant circuit which is constituted by a compressor 25, a water heat exchanger 26 constituting the heat exchanger path 14, a motor-operated expansion valve (decompression mechanism) 27, and an air heat exchanger (evaporator) 28 which are connected in this order. In other words, a discharge pipe 29 of the compressor 25 is connected with the water heat exchanger 26, the water heat exchanger 26 is connected with the motor-operated expansion valve 27 by a refrigerant path 30, the motor-operated expansion valve 27 is connected with the evaporator 28 by a refrigerant path 31, and the evaporator 28 is connected with the compressor 25 by a refrigerant path 33 in which an accumulator 32 is interposed. With this arrangement, when the compressor 25 is driven, water flowing in the heat exchanger path 14 is heated by the water heat exchanger 26. Furthermore, a fan 34 adjusting the ability of the evaporator 28 is added to the evaporator 28.

According to the hot water supplier configured as described above, when the compressor 25 is driven and the water circulating pump 13 is driven (operated), stored water (low temperature water) flows from the water intake 10 provided at the bottom of the hot water storage tank 3 and then flows through the heat exchanger path 14 of the circulation path 12. At that time, this water is heated (boiled) by the water heat exchanger 26 and returned to the upper part of the hot water storage tank 3 through the hot water inlet 11. Such operations are performed continuously and thereby high temperature hot water can be stored in the hot water storage tank 3. During the operation of the hot water supplier, discharge pipe control is performed which adjusts the degree of opening, etc. of the motor-operated expansion valve 27 to match the discharge pipe temperature of the compressor 25 to a target discharge pipe temperature. Since a mid night electricity unit rate is set lower than a daytime electricity unit rate in a present electricity rate system, this operation is performed mainly in a midnight time period (for example, a time period from 23:00 to 7:00) during which an electricity unit rate is low. Such a heat pump hot water supplier is known from, for example, JP 2003-222406 A.

In addition, an excessive temperature rise preventer (bimetal thermostat) 50 is mounted on the top of the hot water storage tank 3 as shown in FIG. 3 in order to prevent various malfunctions from occurring due to an abnormal temperature rise of hot water in the hot water storage tank 3. An application example of such an excessive temperature rise preventer (bimetal thermostat) 50 is known from, for example, JP 2000-39144 A or JP 11-108417 A.

In the hot water supplier, when a temperature detected by the discharged hot water thermistor 21*a* exceeds a predetermined temperature or when the temperature of the top of the hot water storage tank 3 increases and the excessive temperature rise preventer (bimetal thermostat) 50 operates, the compressor 25 is shut down from the viewpoint of securing safety. In other words, in the conventional hot water supplier, a power supply is connected, as shown in FIG. 3, to a power supply unit 52 of the heat pump unit 1 through a tank printed circuit board 51 of the tank unit 2, and the power supply unit 52 supplies power to a heat pump control section 53. The heat pump control section 53 is for controlling the drive frequency of the compressor 25 and the degree of opening of the motor-operated expansion valve 27. By the operation of the bimetal thermostat 50, a power supply line 54 between the tank printed circuit board 51 and the power supply unit 52 is shut off. The reference numeral 55 denotes a tank control section.

However, the fact is that the excessive temperature rise preventer (bimetal thermostat) 50 is very expensive and cannot sufficiently respond to a request of equipment cost down.

SUMMARY OF THE INVENTION

It is therefore an object of the present invention to provide a malfunction detection device of a hot water supplier which is able to prevent various malfunctions, as before, from occurring due to an abnormal temperature rise of hot water in a hot water storage tank and is able to be configured at low cost.

The present invention provides a malfunction detection device for a hot water supplier comprising:

a heat pump unit heating water; and a tank unit having a hot water storage tank for storing heated hot water, a tank temperature detecting section detecting a hot water temperature of the hot water storage tank, and a tank control section, wherein the tank control section of the tank unit controls an energization switching section switching between permission and non-permission of power supply from the tank unit to the heat pump unit such that when a heat pump shutdown command is given to the tank control section, energization of the heat pump unit is stopped and when a hot water temperature of the hot water storage tank detected by the tank temperature detecting section becomes a reference temperature or more, power supply from the tank unit to the heat pump unit is stopped.

In accordance with one aspect of the present invention, the heat pump shutdown command is a standby power saving command for saving a standby power of the heat pump unit.

In accordance with another aspect of the present invention, the tank temperature detecting section functions also as a residual hot water quantity detector of the hot water storage tank.

In accordance with another aspect of the present invention, the hot water supplier comprises a water heat exchanger to be heated by an operation of a compressor, and a circulation path in which influent water from an incoming water piping connected to a bottom of the hot water storage tank is heated by the water heat exchanger and supplied to an upper part of the hot water storage tank through a discharged hot water piping. The hot water supplier further comprises a control system controlling the operation of the compressor and/or an amount of circulating hot water of the circulation path on the basis of a temperature of hot water discharged from the water heat exchanger. The tank temperature detecting section functions also as a discharged hot water temperature detecting section detecting the temperature of hot water discharged from the water heat exchanger.

As is clear from the above description, according to a malfunction detection device of a hot water supplier according to the present invention, safety can be secured, as before, using a cheap temperature detecting means such as a temperature thermistor without needing to use an expensive excessive temperature rise preventer (bimetal thermostat) as before, so that significant cost reduction of the hot water supplier can be achieved.

Furthermore, standby power saving for saving a standby power is performed at the same time, so that the control configuration is simplified and therefore further cost reduction can be achieved.

In addition, if the tank temperature detecting section is also used as a residual hot water quantity detector, or if the tank temperature detecting section is also used as a discharged hot water temperature detecting section, the control configuration is simplified and therefore further cost reduction can be achieved.

DETAILED DESCRIPTION OF THE INVENTION

Next, concrete embodiments of a malfunction detection device of a hot water supplier according to the present invention will be described in detail with reference to the figures.

Figure 1:
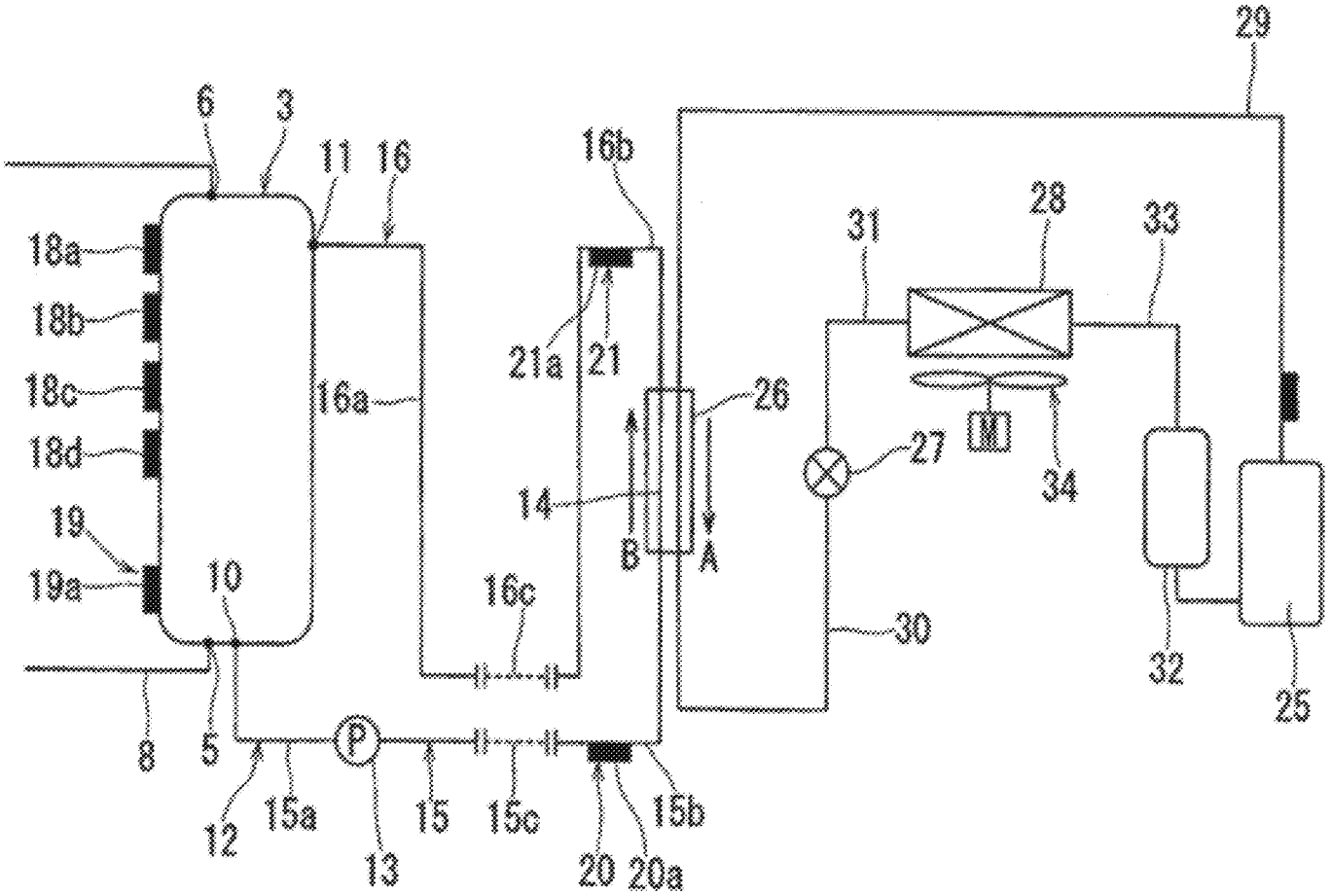
Fig.1 (PRIOR ART)
FIG. 1 is a simplified circuit diagram of a prior art hot water supplier in which a malfunction detection device according to the present invention can be used.
Figure 2:
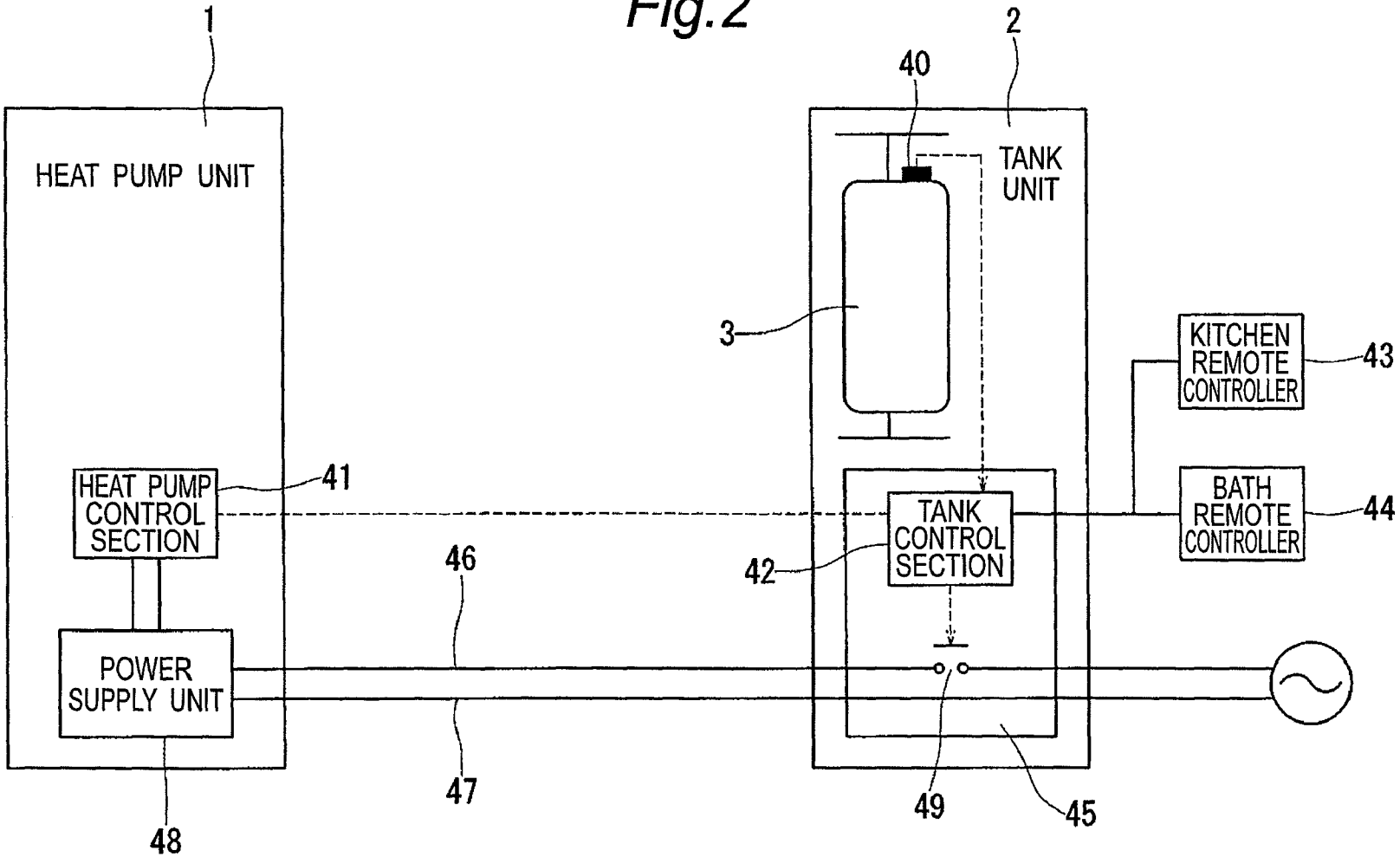
FIG. 2 is a simplified Hock diagram of a control section of the malfunction detection device of the hot water supplier.
Figure 3:
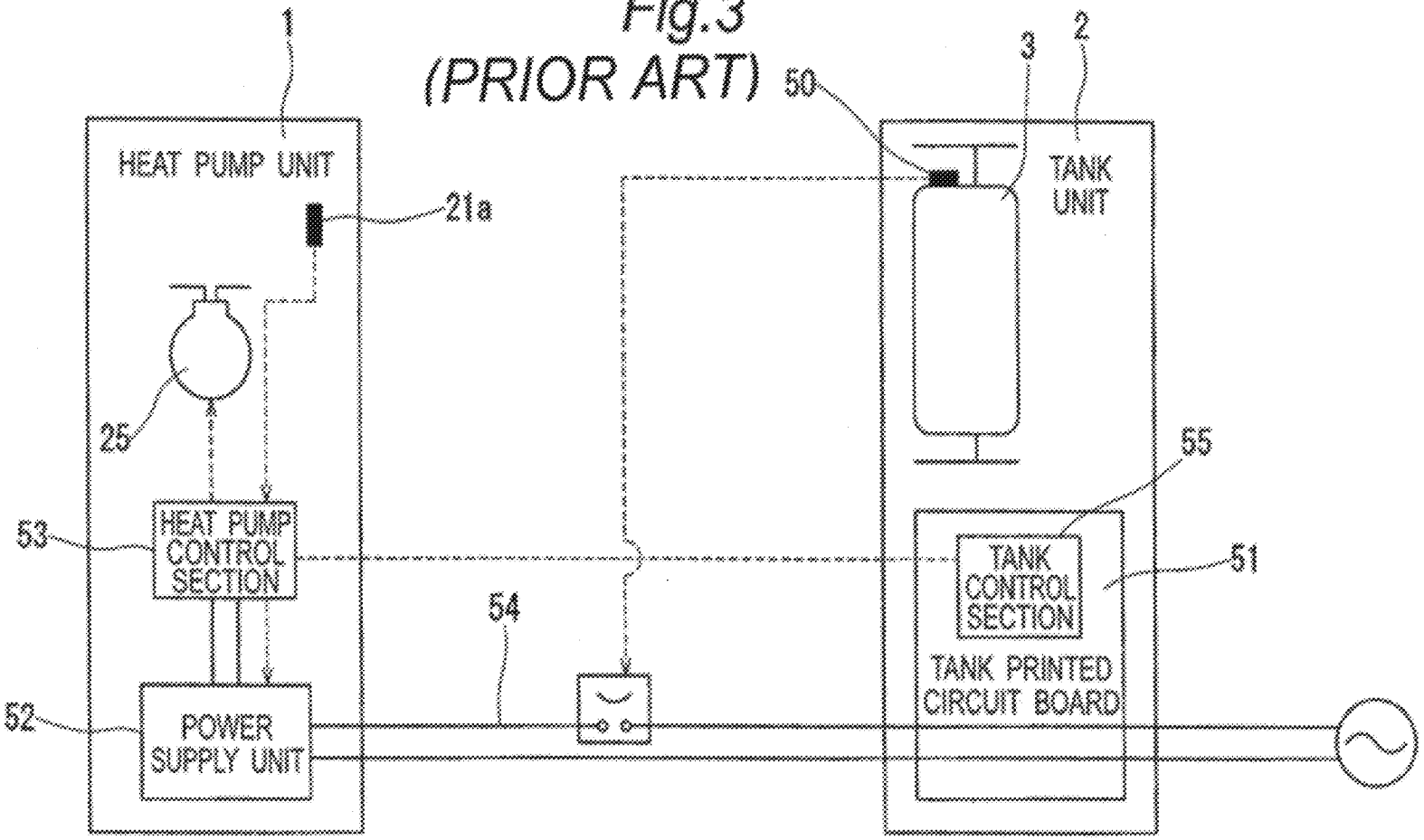
Fig.3 (PRIOR ART)
FIG. 3 is a simplified block diagram of a prior art control section of a conventional malfunction detection device of a hot water supplier.

FIG. 1 is a simplified circuit diagram of a hot water supplier (heat pump hot water supplier), description about which is the same as the above description related to the conventional one and is therefore omitted. First, in FIG. 2, the reference numeral 1 denotes a heat pump unit and the reference numeral 2 denotes a tank unit. These are the same as those described in relation to FIG. 1. Furthermore, the reference numeral 41 denotes a heat pump control section and the reference numeral 42 denotes a tank control section. A kitchen remote controller (main remote controller) 43 and a bath remote controller (sub-remote controller) 44 are connected with the tank control section 42. The tank control section 42 is provided with a tank printed circuit board 45 as in the conventional one. On the other hand, power supply lines 46 and 47 are connected with a power supply unit 48 of the heat pump unit 1 through the tank printed circuit board 45. Furthermore, in the tank printed circuit board 45, a relay 49 is interposed in the power supply line 46. The relay 49 is an energization switching section, the function of which will be described later. In addition, as shown in FIG. 2, a tank temperature thermistor 40, which serves as a tank temperature detecting section detecting the temperature of hot water in the hot water storage tank 3, is mounted on the top of the hot water storage tank 3. The heat pump control section 41 and the tank control section 42 constitute a control system.

The kitchen remote controller 43 and the bath remote controller 44 each are configured to output a shutdown command to the tank control section 42. This command is used to save a standby power in such a case that a person will be away from home for several days while the heat pump unit 1 will be stopped. When such a standby power saving command is input from the kitchen remote controller 43 or the bath remote controller 44 to the tank control section 42, the tank control section 42 causes the off-operation of the relay 49 of the power supply line 46 so as to stop power supply to the heat pump unit 1. This embodiment uses such a function. In other words, when the temperature of hot water in the tank detected by the tank temperature thermistor 40 is in a state of an abnormal temperature rise of, for example, more than 95° C., an abnormal temperature rise output (i.e. an output indicating the abnormal temperature rise) is sent from the tank temperature thermistor 40 to the tank control section 42, which then controls the relay 49 to perform the off-operation in order to stop the power supply.

The concrete embodiment of the present invention has been described. However, the present invention is not limited to the embodiment and may be implemented with various modifications within the scope of the present invention. For example, although in the above-described example, both of the tank temperature thermistor 40 and the discharged hot water temperature detecting section (discharged hot water thermistor) 21 are provided separately, the tank temperature thermistor 40 may double as the discharged hot water temperature detecting section. In this case, further cost reduction can be achieved. Likewise, the tank temperature thermistor 40 may also double as the residual hot water quantity detector 18*a*. Also in this case, cost reduction can be achieved.

In addition, although the output of the tank temperature thermistor 40 is directly sent to the tank control section 42 in this embodiment, this output may be once sent to the heat pump control section 41, which then sends a command to the tank control section 42 to cause the off-operation of the relay 49. Furthermore, the heat pump control section 41 may receive an abnormal temperature rise output from the tank temperature thermistor 40 and output a command to shut down the power supply unit 48.

Furthermore, it is preferable to use carbon dioxide as a refrigerant of a hot water supplier using this malfunction detection device. However, another refrigerant such as dichlorodifluoromethane (R-12) or chlorodifluoromethane (R-22) may be used, or, an alternative refrigerant such as 1,1,1,2-tetrafluoroethane (R-134a) may be used in consideration of problems such as destruction of the ozone layer and environmental pollution.

What is claimed is:

1. A malfunction detection device for a hot water supplier, the malfunction detection device comprising:

a heat pump unit configured to heat water, the heat pump unit having a power supply unit;

a tank unit having a hot water storage tank configured to store heated hot water, a tank temperature detecting section configured to detect a hot water temperature of the hot water in the storage tank, and a tank control section;

a power supply line connecting a power supply to the power supply unit of the heat pump unit through the tank unit; and an energization switching section provided in the power supply line and configured to be switchable between permission and non-permission of power supply from the tank unit to the heat pump unit, the tank control section of the tank unit being configured to control the energization switching section such that when a heat pump shutdown command is given to the tank control section, energization of the heat pump unit is stopped and when a hot water temperature of the hot water storage tank detected by the tank temperature detecting section becomes at least a reference temperature, power supply from the tank unit to the heat pump unit is stopped, the heat pump shutdown command being a command received from a remote controller.

2. The malfunction detection device as claimed in claim 1, wherein the heat pump shutdown command is a standby power saving command in order to save a standby power of the heat pump.

3. The malfunction detection device as claimed in claim 1, wherein the tank temperature detecting section is further configured to detect a residual hot water quantity in the hot water storage tank.

4. The malfunction detection device as claimed in claim 1, wherein the tank unit further has a tank printed circuit board, and the tank control section and the energization switching section are provided at the printed circuit board.

5. A malfunction detection device for a hot water supplier, the malfunction detection device comprising:

a heat pump unit configured to heat water;

a tank unit having a hot water storage tank, configured to store heated hot water, a tank temperature detecting section configured to detect a hot water temperature of the hot water in the storage tank, and a tank, control section; and a control system, the tank control section of the tank unit being configured to control an energization switching section that is switchable between permission and non-permission of power supply from the tank unit to the heat pump unit such that when a heat pump shutdown command is given to the tank control section, energization of the heat pump unit is stopped and when a hot water temperature of the hot water storage tank detected by the tank temperature detecting section becomes at least a reference temperature, power supply from the tank unit to the heat pump unit is stopped, the hot water supplier including a water heat exchanger configured to be heated by an operation of a compressor, and a circulation path in which influent water from an incoming water piping connected to a bottom of the hot water storage tank is heated by the water heat exchanger and supplied to an upper part of the hot water storage tank through a discharged hot water piping, the control system being configured to control at least one of the operation of the compressor and an amount of circulating hot water of the circulation path based on a temperature of hot water discharged from the water heat exchanger, and the tank temperature detecting section being further configured to detect a discharged hot water temperature of hot water discharged from the water heater exchanger.

6. A malfunction detection device for a hot water supplier, the hot water supplier including a heat pump unit configured to heat water, the heat pump unit having a power supply unit, and a tank unit having a hot water storage tank configured to store heated hot water, the malfunction detection device comprising:

a power supply line connecting a power supply to the power supply unit of the heat pump unit through the tank unit;

a tank control section for the tank unit, with a remote controller connected to the tank control section; and a tank temperature detector provided at the hot water storage tank to detect a temperature of the hot water in the hot water storage tank, the tank control section including an energization switching section that is provided in the power supply line and configured to be switchable between permission and non-permission of power supply from the tank unit to the heat pump unit, the tank control section being configured to control the energization switching section to stop energization of the heat pump unit when a standby power saving command is inputted to the tank control section from the remote controller in order to save a standby power of the heat pump unit, and the tank control section being further configured to control the energization switching section to stop energization of the heat pump unit also when the temperature of the hot water in the hot water storage tank detected by the tank temperature detector is equal to or higher than a reference temperature.

7. The malfunction detection device as claimed in claim 6, wherein the tank temperature detector is further configured to function as a residual hot water quantity detector of the hot water storage tank.

8. The malfunction detection device as claimed in claim 6, wherein the tank unit further has a tank printed circuit board, and the tank control section and the energization switching section are provided at the printed circuit board.

9. A malfunction detection device for a hot water supplier, the hot water supplier including a heat pump unit configured to heat water and a tank unit having a hot water storage tank configured to store heated hot water, the malfunction detection device comprising:

a tank control section for the tank unit, with a remote controller connected to the tank control section; and a tank temperature detector provided at the hot water storage tank to detect a temperature of the hot water in the hot water storage tank, the tank control section including energization switching section that is switchable between permission and non-permission of power supply from the tank unit to the heat pump unit, the tank control section being configured to control the energization switching section to stop energization of the heat pump unit when a standby power saving command is inputted to the tank control section from the remote controller in order to save a standby power of the heat pump unit, the tank control section being further configured to control the energization switching section to stop energization of the heat pump unit also when the temperature of the hot water in the hot water storage tank detected by the tank temperature detector is equal to or higher than a reference temperature, the hot water supplier further including a water heat exchanger configured to be heated by an operation of a compressor, a circulation path in which influent water from an incoming water piping connected to a bottom of the hot water storage tank is heated by the water heat exchanger and supplied to an upper part of the hot water storage tank through a discharged hot water piping, and a discharged hot water temperature detector configured to detect a temperature of hot water discharged from the water heat exchanger, the malfunction detection device being configured to control at least one of the operation of the compressor and an amount of circulating hot water in the circulation path based on the discharged hot water temperature detected by the discharged hot water temperature detector, and the discharged hot water temperature detector being used also as the tank temperature detector.

10. A malfunction detection device for a hot water supplier, the malfunction detection device comprising:

a heat pump unit configured to heat water; and a tank unit having a hot water storage tank configured to store heated hot water, a tank temperature detecting section configured to detect a hot water temperature of the hot water in the storage tank, and a tank control section, the tank control section of the tank unit being configured to control an energization switching section that is switchable between permission and non-permission of power supply from the tank unit to the heat pump unit such that when a heat pump shutdown command is given to the tank control section, energization of the heat pump unit is stopped and when a hot water temperature of the hot water storage tank detected by the tank temperature detecting section becomes at least a reference temperature, power supply from the tank unit to the heat pump unit is stopped, the heat pump shutdown command being a command received from a remote controller and the heat pump shutdown command being a standby power saving command in order to save a standby power of the heat pump, the hot water supplier further including a water heat exchanger configured to be heated by an operation of a compressor, a circulation path in which influent water from an incoming water piping connected to a bottom of the hot water storage tank is heated by the water heat exchanger and supplied to an upper part of the hot water storage tank through a discharged hot water piping, and a discharged hot water temperature detector configured to detect a temperature of hot water discharged from the water heat exchanger, the malfunction detection device being configured to control at least one of the operation of the compressor and an amount of circulating hot water in the circulation path based on the discharged hot water temperature detected by the discharged hot water temperature detector, and the discharged hot water temperature detector being used also as the tank temperature detector.

11. A malfunction detection device for a hot water supplier, the malfunction detection device comprising:

a heat pump unit configured to heat water; and a tank unit having a hot water storage tank configured to store heated hot water, a tank temperature detecting section configured to detect a hot water temperature of the hot water in the storage tank, and a tank control section, the tank control section of the tank unit being configured to control energization switching section that is switchable between permission and non-permission of power supply from the tank unit to the heat pump unit such that when a heat pump shutdown command is given to the tank control section, energization of the heat pump unit is stopped and when a hot water temperature of the hot water storage tank detected by the tank temperature detecting section becomes at least a reference temperature, power supply from the tank unit to the heat pump unit is stopped, the heat pump shutdown command being a command received from a remote controller, the hot water supplier including a water heat exchanger configured to be heated by an operation of a compressor, and a circulation path in which influent water from an incoming water piping connected to a bottom of the hot water storage tank is heated by the water heat exchanger and supplied to an upper part of the hot water storage tank through a discharged hot water piping, the malfunction detection device further comprises a control system configured to control at least one of the operation of the compressor and an amount of circulating hot water of the circulation path based on a temperature of hot water discharged from the water heat exchanger, and the tank temperature detecting section being further configured to detect a discharged hot water temperature of hot water discharged from the water heater exchanger.

* * * * *